US007235750B1

(12) United States Patent
Coutu, Jr. et al.

(10) Patent No.: US 7,235,750 B1
(45) Date of Patent: Jun. 26, 2007

(54) RADIO FREQUENCY MEMS SWITCH CONTACT METAL SELECTION

(75) Inventors: Ronald A. Coutu, Jr., Beavercreek, OH (US); Paul E. Kladitis, New Carlisle, OH (US); Robert L. Crane, Kettering, OH (US); Kevin D. Leedy, Centerville, OH (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 362 days.

(21) Appl. No.: 11/047,344

(22) Filed: Jan. 31, 2005

(51) Int. Cl.
*H01H 57/00* (2006.01)

(52) U.S. Cl. ..... 200/181; 335/78; 257/414; 257/411; 438/107; 438/109

(58) Field of Classification Search ..... 200/181; 335/78; 257/411–414, 531; 438/107–110
See application file for complete search history.

(56) References Cited

U.S. PATENT DOCUMENTS

| | | | | |
|---|---|---|---|---|
| 5,597,064 | A | 1/1997 | Ozaki et al. | |
| 6,373,007 | B1 | 4/2002 | Calcatera et al. | |
| 6,384,353 | B1 * | 5/2002 | Huang et al. | 200/181 |
| 6,624,498 | B2 | 9/2003 | Filas et al. | |
| 6,655,964 | B2 | 12/2003 | Fork et al. | |
| 6,777,629 | B2 * | 8/2004 | Lane et al. | 200/181 |
| 6,793,753 | B2 | 9/2004 | Unger et al. | |
| 6,888,420 | B2 * | 5/2005 | Schaffner et al. | 333/101 |
| 6,894,383 | B2 * | 5/2005 | Bar-Sadeh et al. | 257/704 |
| 6,969,635 | B2 * | 11/2005 | Patel et al. | 438/107 |
| 7,042,319 | B2 * | 5/2006 | Ishiwata et al. | 335/78 |
| 2003/0116417 | A1 | 6/2003 | DeReus | |
| 2003/0116848 | A1 | 6/2003 | Cunningham et al. | |
| 2003/0117257 | A1 | 6/2003 | Cunningham | |
| 2003/0223174 | A1 | 12/2003 | Prophet | |
| 2003/0230798 | A1 | 12/2003 | Lin et al. | |
| 2004/0012298 | A1 | 1/2004 | Cunningham et al. | |
| 2004/0016995 | A1 | 1/2004 | Kuo et al. | |
| 2004/0067604 | A1 | 4/2004 | Ouellet et al. | |

OTHER PUBLICATIONS

S. Majumder et al, "MEMS Switches", IEEE Instrumentation & Measurement Magazine, Mar. 2003, pp. 12-15.
S. Duffy et al., "MEMS Microswitches for Reconfigurable Microwave Circuitry", IEEE Microwave and Wireless Components Letters, Mar. 2001, pp. 106-108, vol. 11.
J. Schimkat, "Contact Measurements Providing Basic Design Data for Microrelay Actuators", Sensors and Actuators, 1999, pp. 138-143, vol. 73.
Ronald Coutu et al., "Selecting Metal Alloy Electric Contact Materials for MEMS Switches", Journal of Micromechanics and Microengineering, 2004, pp. 1157-1164, vol. 14.

* cited by examiner

*Primary Examiner*—K. Lee
(74) *Attorney, Agent, or Firm*—AFMCLO/JAZ; Gerald B. Hollins

(57) ABSTRACT

A method for selecting metal alloys as the electric contact materials for microelectromechanical systems (MEMS) metal contact switches. This method includes a review of alloy experience, consideration of equilibrium binary alloy phase diagrams, obtaining thin film material properties and, based on a suitable model, predicting contact electrical resistance performance. After determination of a candidate alloy material, MEMS switches are conceptualized, fabricated and tested to validate the alloy selection methodology. Minimum average contact resistance values of 1.17 and 1.87 ohms are achieved for micro-switches with gold (Au) and gold-platinum (Au-(6.3 at %)Pt) alloy contacts. In addition, 'hot-switched' life cycle test results of $1.02\times10^8$ and $2.70\times10^8$ cycles may be realized for micro-switches with Au and Au-(6.3 at %)Pt contacts. These results indicate increased wear with a small increase in contact resistance for MEMS switches with metal alloy electric contacts.

16 Claims, 5 Drawing Sheets

RADIO FREQUENCY MEMS SWITCH CONTACT METAL SELECTION

CROSS REFERENCE TO RELATED PATENT DOCUMENTS

The present document is somewhat related to the copending and commonly assigned patent application document "SHAPED MEMS CONTACT", Ser. No. 11/047,345 filed of even date herewith. The contents of this related even filing date application are hereby incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

Radio frequency microelectromechanical systems (MEMS) switches are of paramount in importance for future miniaturizations of radio frequency systems. Space-based radar, phased array radar and phase shifters all depend on being able to easily and reliably switch between different radio frequency loads. Because of their small geometries, exceptional performance and low power consumptions, MEMS metal contact switches are well suited for these applications.

Important performance criteria for many MEMS metal contact switch applications are low contact resistance, resistance preferably less than one ohm and not more than two ohms in magnitude, and high reliability; for example an operating life of more than $10^8$ 'hot-switched' cycles. The two primary failure mechanisms for metal contact switches involve the switch becoming stuck in the closed position (i.e. stiction) or incurring increasing contact resistance as a result of increasing switch operating cycles. Typically, MEMS metal contact switches use gold-on-gold electric contacts in order to achieve the desired low contact resistance. This low resistance results of course from gold's low electrical resistivity and its resistance to surface oxide and sulfide layer formations. However, MEMS switches with gold electric contacts are prone to the stiction and increased contact resistance failure mechanisms because of gold's relatively low hardness, a hardness of 1-2 GPa is typical.

Previous work in this field has focused on the optimizing of mechanical switch configurations rather than investigating different electric contact metallurgies. Notable exceptions to this focusing on the optimizing of mechanical switch configurations are the work of S. Majumder et al. and S. Duffy et al. which involve 'platinum group' and platinum electric contact metals, respectively [1, 2]. Bracketed numbers such as this refer to individual items in the list of references appearing in the APPENDIX located at the end of this specification; these references are hereby incorporated by reference herein. These metals were chosen over gold for their increased hardness and improved wear characteristics. In order to achieve acceptable contact resistance values, the Majumder et al. switches require multiple, parallel contacts and are packaged in a novel hermetic environment while the Duffy et al. switches require very high actuation voltages of about 80 Volts.

J. Schimkat studied gold-nickel alloy (Au-(5 at %)Ni) macro-switch contacts in a low-force test configuration but did not fabricate or test actual MEMS devices [3]. Currently, there are no other known works appearing in the open published literature describing how to select and incorporate metal alloys as micro-switch electric contact materials. The present invention provides a method for selecting metal alloy electric contact materials for micro-switches that are optimized for increased wear, low contact resistance and low susceptibility to oxidation, to contaminant gettering and to the formation of sulfide layers. The present invention is thus believed to provide a desirable contribution toward resolution of the MEMS radio frequency switch contact metal difficulty.

SUMMARY OF THE INVENTION

The present invention provides a technique for selecting alloy metals for successful use in a radio frequency microelectromechanical switch contact elements.

It is therefore an object of the present invention to provide an easy and quickly implemented gold inclusive microelectromechanical alloy selection arrangement.

It is another object of the invention to provide a MEMS contact arrangement affording desirable mechanical wear resistance.

It is another object of the invention to provide an exemplary gold alloy found to be useful in MEMS switch fabrication.

It is another object of the invention to disclose phase diagram characteristics of gold alloys usable in MEMS switch embodiments.

It is another object of the invention to provide a measure of MEMS switch characteristics for switches fabricated with the exemplary gold alloy.

It is another object of the invention to disclose MEMS switch life cycle data for switches fabricated with the exemplary gold alloy.

It is another object of the invention to provide microelectromechanical switch contacts affording desirable low susceptibility to oxidation contaminant gettering and sulfide layer formation.

These and other objects of the invention will become apparent as the description of the representative embodiments proceeds.

These and other objects of the invention are achieved by the method of achieving a gold alloy contact-inclusive radio frequency microelectromechanical systems switch comprising the steps of:

electing a microelectromechanical systems switch mechanism configuration providing a selected range of switch electrical contact force capability and limited switch electrostatic pull-in voltage requirement;

selecting candidate radio frequency microelectromechanical systems electrical switch contact metal alloys for use with said elected switch mechanism configuration from a collection of gold inclusive binary miscible alloys;

said selecting step including embracing a plurality of gold inclusive alloys of suitable equilibrium binary alloy phase diagrams and known suitable binary alloy bulk material resistivity data for said candidate gold inclusive alloys;

said selecting step additionally including exclusion of candidate gold alloys having multiple stable alloy phases and intermetallic compound attributed phase diagram regions;

said selecting step further including exclusion of gold alloy combinations having electrical resistivity characteristics in excess of a selected level;

said selecting step alloy having one of, a palladium of concentration of less than ten percent, a platinum of concentration of less than fifteen percent and a silver concentration of less than fifteen percent;

choosing an appropriate thin film deposition method for a contact alloy designated from said selected candidate radio frequency microelectromechanical systems switch contact gold inclusive alloys;

forming said designated alloy using one of a physical vapor deposition process and a chemical vapor deposition process operating at an alloying temperature below that of phase diagram multiple phases formation and phase diagram miscibility gap occurrence.

BRIEF DESCRIPTION OF THE DRAWING

The accompanying drawings incorporated in and forming a part of the specification, illustrate several aspects of the present invention and together with the description serve to explain the principles of the invention. In the drawings.

DETAILED DESCRIPTION OF THE INVENTION

It is desirable that radio frequency MEMS switch fabrication be consistent and repeatable. Toward this end the present invention includes procedure for selecting alloy electric contact metallurgies for microswitches; measuring Au—Pd, Au—Pt and Au—Ag thin film material properties relating to such contacts; accomplishing fabrication of RF MEMS switches with Au-(6.3 at %)Pt alloy electric contacts, measuring contact resistance and considering switch life cycle test results. The expression (6.3 at %)Pt designates an atomic percentage of Platinum.

According to the Metals Handbook, "- - - no metal has all the desired properties required to accomplish the objectives of different (switch) contact applications. Intuitively, this generalization appears correct because requirements (i.e. service life, load, etc) change for different switch applications. Desired electric contact properties include low electrical resistance, high thermal conductivity, absence of insulating oxides or sulfides, nominal hardness and elastic modulus, and a high melting point. Although most metals have been considered, silver and its alloys are the most widely used macro-switch electric contact materials because of the superior electrical, mechanical and thermodynamic properties achieved. One drawback to the use of silver is that it tarnishes in the presence of sulfur and forms mechanically robust surface sulfide layers. Although, not a big problem for macro-switches, where many Newtons of contact force are available to penetrate nonconductive surface layers, in micro-switches pure silver or alloys with high percentages of silver are not suitable electric contact materials.

Gold contacts, on the other hand, are widely used in microswitches due to the achieved low resistivity, high oxidation resistance and easy integration with available device fabrication processes. Gold, however, is a very soft metal, has a low melting point temperature and adsorbs carbonaceous layers. These properties make gold electric contacts prone to erosion and wear. Although gold is a soft metal, it can be hardened using alloying elements or solutes such as nickel (Ni), palladium (Pd), silver (Ag) or platinum (Pt) to help minimize contact wear and erosion. The resulting alloys are best suited for low current applications because of their relatively low melting point temperatures. These macro-switch experience based principles form the basis for investigating gold alloy contact metals for MEMS switches. Phase diagrams and bulk resistivity values may be used to further investigate binary alloys and determine specific gold alloy compositions. A wealth of knowledge, pertinent to configuring MEMS switches, is in fact gained by considering binary alloy phase diagrams.

Figure 1:
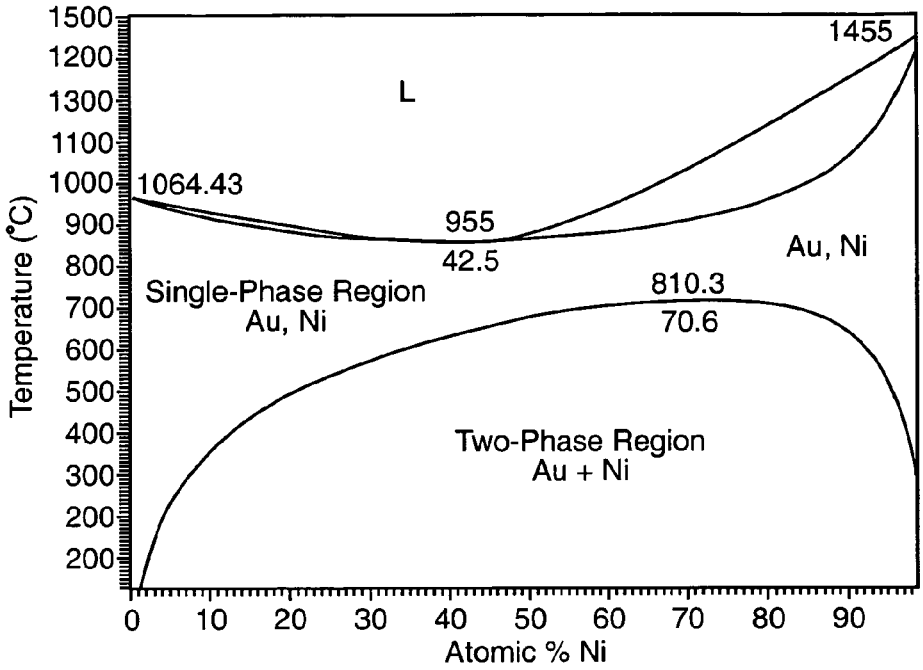
FIG. 1 shows an equilibrium binary alloy phase diagram for a gold-nickel alloy.

With the use of phase diagrams, single-phase alloys and miscibility regions characteristic of specific alloys are located. Single-phase alloys are desired for MEMS contacts because metal alloy crystal structures found in these areas do not physically change with elevated temperature. Miscibility gaps or two-phase regions should be avoided in MEMS contacts in order to (1) ensure that contact alloys are reliably deposited during device fabrication and (2) to avoid brittle, highly resistive, intermetallic compounds that may inadvertently be formed. In fact miscible gold alloys made from low concentrations of alloying elements are desirable to avoid depositing intermetallic compounds during MEMS device fabrication. Most binary metal alloys obey Matthiessen's rule where the relationship between resistivity and alloy composition is a parabolic curve in nature and a trade-off situation usually exists between bulk resistivity and other material properties such as hardness or elastic modulus. J. Schimkat tested gold-nickel alloy (Au-(5 at %)Ni) macroswitch electric contacts under low contact force conditions of 100 to 600 microNewtons and theorized that Au—Ni alloys were useful micro-relay contact materials [3]. In the FIG. 1 drawing herein however, the Au—Ni phase diagram shows the existence of two stable alloy phases across the entire component composition range below 810.3° C. The miscibility gap or two-phase region, shown in FIG. 1 thus indicates that Au—Ni alloys are not necessarily the best choice for micro-switch electric contacts because intermetallics and unpredicted material second phases will almost certainly be present in such alloys. This hypothesis is also supported by the erratic bulk resistance ratios, reported in the CRC Handbook of Electrical Resistivities of Binary Metallic Alloys, resistance ratios that do not follow Matthiessen's rule. The alloy composition Schimkat tested is a stable, two-phase material. As a result of normal alloy deposition process variations (i.e. temperature, pressure, etc), this precise Au—Ni composition is however extremely difficult to reliably duplicate and incorporate into a microswitch fabrication processes.

Figure 2:
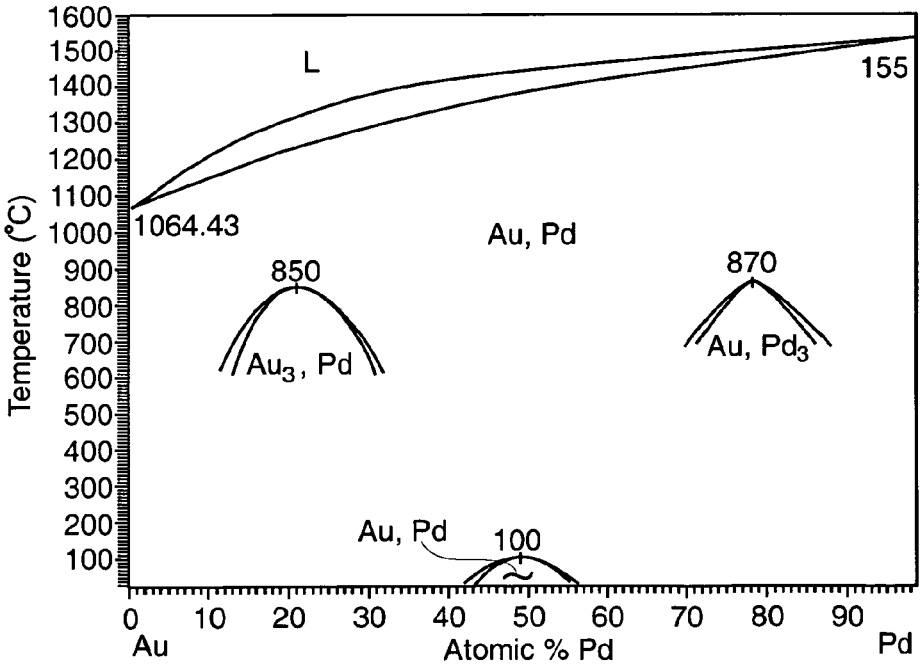
FIG. 2 shows an equilibrium binary alloy phase diagram for a gold-palladium alloy.
Figure 3:
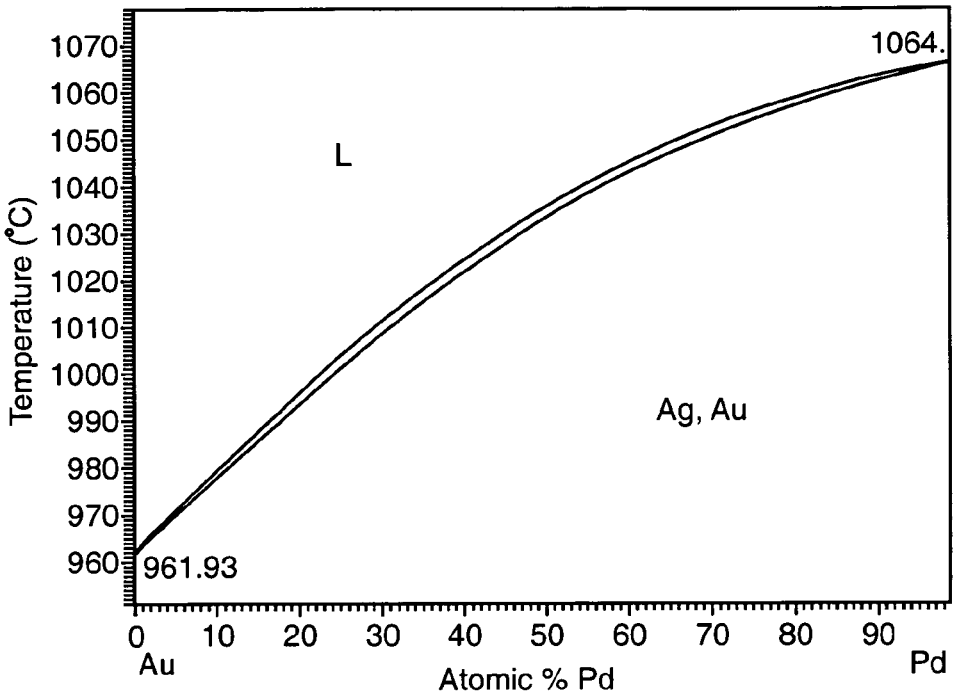
FIG. 3 shows an equilibrium binary alloy phase diagram for a gold-silver alloy.
Figure 4:
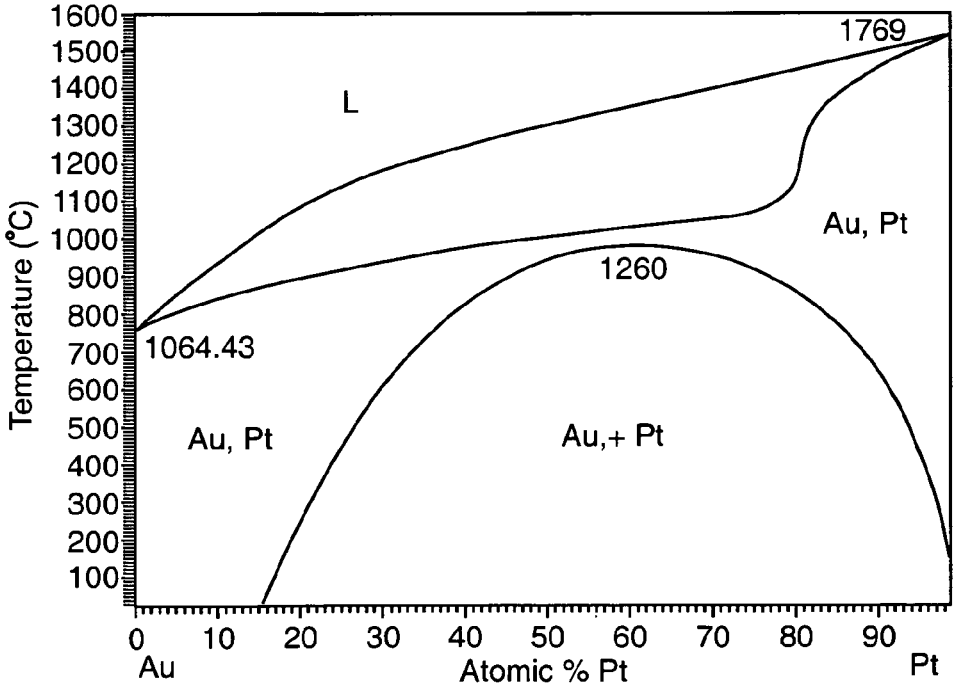
FIG. 4 shows an equilibrium binary alloy phase diagram for a gold-platinum alloy.

FIGS. 2-4 in the drawings show the phase diagrams for Au—Pd, Au—Ag and Au—Pt alloys, respectively. The FIG. 2 Au—Pd phase diagram shows one stable alloy phase below 1064.43° C. and three known regions where intermetallic compounds form. Single-phase Au—Pd alloys normally result however when using Pd concentrations of less than ~10%. The FIG. 3 Au—Ag phase diagram shows one stable material phase for all alloy compositions. The melting temperature for Au—Ag alloys increases from 961.93° C. to 1064.00° C. as the Au concentration increases from 0 to 100%. Miscible Au—Ag alloys with Ag concentrations less than ~30% are less likely to tarnish in the presence of sulfur. Au—Ag alloys with less than ~15% silver content are considered for the present invention. The FIG. 4 Au—Pt phase diagram shows two stable phases below 1260° C. but only with platinum (Pt) concentrations greater than ~15%. Single-phase Au—Pt alloys result for Pt concentrations of less than ~15%. The information from the FIG. 1, FIG. 2 and FIG. 3 phase diagrams along with the low bulk material resistivity values, found in the CRC Handbook of Electrical Resistivities of Binary Metallic Alloys, indicates that Au—Pd, Au—Ag and Au—Pt alloys are viable candidates for MEMS electric contacts.

There are several other possible metals that can potentially be alloyed with gold, platinum or palladium to form micro-switch electric contacts. The most notable of these are rhenium (Re), ruthenium (Ru), rhodium (Rh), iridium (Ir), copper (Cu) and cobalt (Co). Gold-rhenium (Au—Re) and gold-iridium (Au—Ir) alloys are not however considered because alloy phase diagrams are not readily available for these material combinations. Phase diagrams for gold-rhodium (Au—Rh), platinum-rhodium (Pt—Rh), platinum-iridium (Pt—Ir), palladium-ruthenium (Pd—Ru) and platinum-palladium (Pt—Pd) alloys are available; however, the bulk material resistivities, found in the CRC Handbook, are much greater for these alloys than those for the Au—Pd, Au—Ag and Au—Pt alloys. Phase diagrams are also available for gold-ruthenium (Au—Ru), platinum-rhenium (Pt—Re), platinum-ruthenium (Pt—Ru), palladium-rhenium (Pd—Re), palladium-rhodium (Pd—Rh), palladium-iridium (Pd—Ir), rhenium-ruthenium (Re—Ru), ruthenium-iridium (Ru—Ir) and rhodium-iridium (Rh—Ir) alloys; however, bulk material resistivities are not readily available for these alloys.

Figure 5:
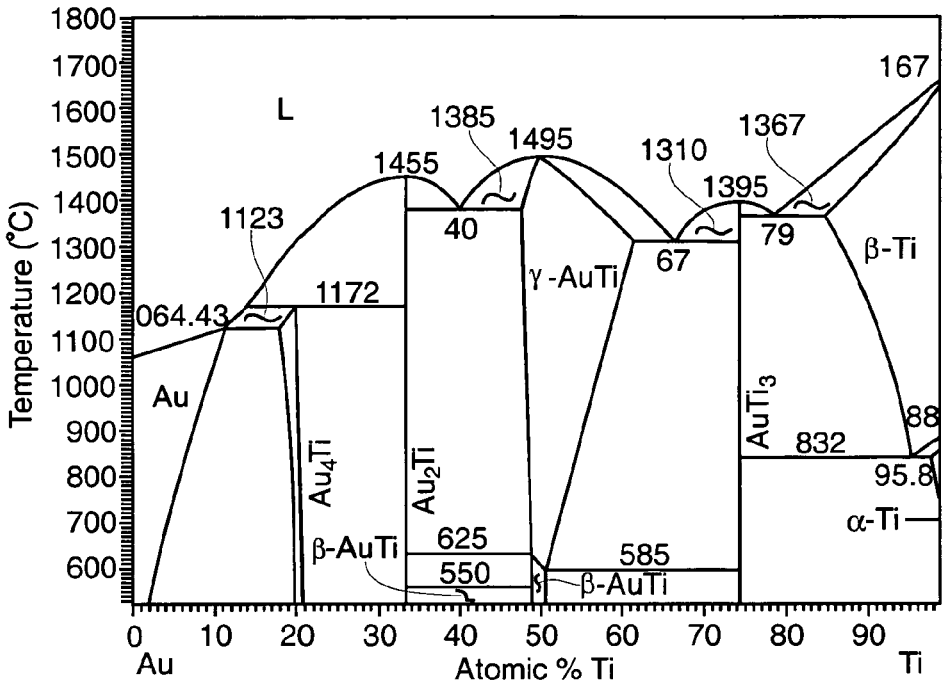
FIG. 5 shows an equilibrium binary alloy phase diagram for a gold-titanium alloy.

Gold-copper (Au—Cu) alloys are not considered in our work because alloys with high concentrations of Cu have a tendency to form robust surface films while alloys with low concentrations of Cu are known to form intermetallic compounds. Gold-cobalt (Au—Co) alloys are also not considered because, like Au—Ni alloys, the two-phase region extends across the entire alloy composition spectrum making reliable, repeatable thin-film deposition difficult. Additionally, gold-titanium (Au—Ti) alloys are not used in this work. Although titanium (Ti) is a popular adhesion metal for gold, particularly for lower switch contacts, it is not a suitable micro-switch electric contact metal. This is due to the numerous miscibility gaps and intermetallic compounds possible as is shown in the FIG. 5 drawing. These compounds are present whenever Au is deposited directly onto Ti. For example, with a composition of 49% Au and 51% Ti, the material physically changes from the β-Au—Ti alloy to the γ-Au—Ti alloy when the temperature increases above ~590° C. Similar metallurgical changes occur when a gold top layer is mechanically worn away from a switch's lower electric contact with high numbers of switch cycles.

In addition to using single phase binary alloys, avoiding intermetallic compounds and materials combinations that tarnish, oxidize or form robust surface films, alloy deposition techniques used with the present invention must be compatible with and easily integrated with available micro-switch fabrication processes.

Thin Film Deposition

Thin metal films are routinely deposited using either physical vapor deposition (PVD) or chemical vapor deposition (CVD) methods. The PVD techniques of sputtering and evaporation, accomplished under vacuum, can be used for depositing metal alloy thin films. Alloy deposition using CVD is more difficult because of its precise stoichiometric dependence. In general, evaporative metal deposition involves heating a material to its melting point and allowing the vaporized atoms, traveling in straight lines, to impinge and condense on a target substrate. Alloys are deposited by using either a single-alloyed material container or by using co-evaporation where two different materials are heated simultaneously. Precise composition control is difficult when evaporating a single container alloy because different metals have different vapor pressures and therefore different evaporation rates. When using co-evaporation obtaining uniform alloy composition, across the target substrate, is difficult because of straight-line evaporation patterns and vapor phase material scattering.

Sputtering is a process wherein inert gas ions (e.g. argon (Ar)) are used to bombard a material target in the presence of an electric field. Once the ions hit the target with sufficient energy, material is dislodged due to an exchange of momentum. The dislodged material is then transported to the substrate ballistically. Like evaporation, alloys can be sputter deposited using either alloyed material targets or by co-sputtering individual materials. Unlike evaporation, however, alloy compositions are better controlled when sputtered because transition to vapor phase is not required.

A Denton Discovery-18 sputtering system may be used to co-sputter the thin metal alloy films of the present invention. In a procedure for co-sputtering alloy films one may characterize the deposition rates for the individual alloy components and then co-sputter at appropriate power levels. Deposition rates may be determined through an iterative process of choosing a chamber pressure, setting the cathode power for an estimated film thickness, verifying film thickness using a Tencor P-10 Surface Profiler and finally adjusting the cathode power level. With these data, deposition rate versus cathode power may be plotted and curve fitted. The curve fit equations may then be used to estimate the cathode power level settings needed to deposit the alloy films.

Three different Au—Pd, Au—Ag and Au—Pt test specimens (~500 Angstroms thick) were co-sputtered onto 3-inch silicon (100) test wafers using this procedure. Material property testing verifies that single-phase alloys were deposited and that two-phase regions and intermetallic compounds were avoided. Thin film material properties, not available in the open literature, were measured directly to ascertain important electrical and mechanical properties.

Material Property Testing

A premise of this work is that suitable MEMS switch electric contacts are realizable when using miscible (i.e. alloy elements that are completely soluble in each other), single-phase alloys and when avoiding two-phase regions and intermetallic compounds. X-ray photoelectron spectroscopy (XPS) and x-ray diffraction (XRD) may be used to evaluate miscibility and composition of the co-sputtered metal alloy films; a detailed crystallography study and compositional analysis need not be performed. XPS may be used to compare actual atomic composition percentages to those predicted prior to deposition and XRD may be used to identify material 20 lines. Nanoindenting and four-point probe resistance measurements may be used to assess thin film hardness and resistivity, respectively, and a surface profiler used to evaluate surface roughness. X-ray photoelectron spectra may be used to verify the alloy composition of each test specimen and investigate the contaminant layers. For example, the composition of the Au-(1 at %)Pt alloy film is approximately 97.8 at % Au and 2.2 at % Pt. The alloy composition measurements for the remaining candidate alloys are presented in Table 1 as appears below.

TABLE 1

XPS composition measurements for the Au—Pt, Au—Pd and Au—Ag test specimens.

| Predicted | Measured |
|---|---|
| Au-(1 at %)Pt | Au(97.8 at %)-(2.2 at %)Pt |
| Au-(2 at %)Pt | Au(93.7 at %)-(6.3 at %)Pt |
| Au-(5 at %)Pt | Au(89.9 at %)-(10.1 at %)Pt |
| Au-(1 at %)Pd | Au(99.3 at %)-(0.7 at %)Pd |
| Au-(3 at %)Pd | Au(98.5 at %)-(1.5 at %)Pd |
| Au-(5 at %)Pd | Au(96.3 at %)-(3.7 at %)Pd |
| Au-(5 at %)Ag | Au(97.9 at %)-(2.1 at %)Ag |
| Au-(7 at %)Ag | Au(94.8 at %)-(5.2 at %)Ag |
| Au-(10 at %)Ag | Au(93.6 at %)-(6.4 at %)Ag |

For present invention alloys all the candidate alloy test specimens are within the single-phase ranges shown in the FIG. 2, FIG. 3 and FIG. 4 phase diagrams. A contaminant layer approximately 20-40 Angstroms thick, consisting of carbon (C) and oxygen (O), is usually present on each of the test specimens. XPS depth profiling (i.e. calibrated sputter cleaning) may be used to determine the thickness and composition of the contaminant layer. Sulfur (S) is usually not present on the samples. XRD may be accomplished on all test specimens to evaluate whether single-phase alloys or intermetallic compounds are present. For example, measured (111) crystal orientation 2θ lines, for sputtered Au, Pt and Au-(2.2 at %)Pt films, are approximately 38.30, 39.92 and 38.40 degrees, respectively. Since the alloy film has only a single 2θ line shifted slightly towards the Pt line, intermetallic compounds are not present in the samples.

All the alloy thin film specimens may be tested using XRD and no intermetallic compounds are observed. Material hardness may be measured using traditional nanoindenting techniques with a MTS Nanoindentor IIs. Ten indents are preferably measured on each of the test specimens. Substrate effects are minimized by limiting the indent depth to approximately 10-15% of a film's overall thickness. Table 2 below presents the hardness data for the sputtered Au—Pt, Au—Pd and Au—Ag test specimens. Au, Pt, Pd and Ag measurements are also provided in Table 2 for comparison.

TABLE 2

Nanoindentor IIs hardness (H) measurements for Au, Pt, Pd, Ag, Au—Pt, Au—Pd and Au—Ag test specimens.

| Material H(GPa) | Standard deviation (GPa) |
|---|---|
| Au | 1.77/0.18 |
| Pt | 3.55/0.25 |
| Pd | 2.87/0.22 |
| Ag | 1.31/0.09 |
| Au-(2.2 at %)Pt | 1.69/0.11 |
| Au-(6.3 at %)P + type | 2.19/0.26 |
| Au-(10.1 at %)Pt | 1.98/0.10 |
| Au-(0.7 at %)Pd | 1.64/0.07 |
| Au-(1.5 at %)Pd | 1.87/0.21 |
| Au-(3.7 at %)Pd | 1.96/0.13 |
| Au-(2.1 at %)Ag | 1.82/0.10 |
| Au-(5.2 at %)Ag | 1.68/0.14 |
| Au-(6.4 at %)Ag | 1.73/0.16 |

A standard four-point probe system may be used to collect thin film resistivity measurements. Ten resistivity measurements are preferred across each of the alloy test wafers to ensure uniform material deposition. Table 3 presents the resistivity data collected for the Au—Pt, Au—Pd and Au—Ag films. Au, Pt, Pd and Ag measurements are provided for comparison.

TABLE 3

Resistivity measured using the four-point probe method for Au, Pt, Pd, Ag, Au—Pt, Au—Pd and Au—Ag test specimens.

| Material | Resistivity (μΩ-cm) | Standard deviation (μΩ-cm) |
|---|---|---|
| Au | 3.93 | 0.0004 |
| Pt | 13.88 | 0.0015 |
| Pd | 13.75 | 0.0006 |
| Ag | 1.78 | 0.0001 |
| Au-(2.2 at %)Pt | 5.83 | 0.0006 |
| Au-(6.3 at %)Pt | 7.17 | 0.0001 |
| Au-(10.1 at %)P + type | 10.60 | 0.0015 |
| Au-(0.7 at %)Pd | 5.14 | 0.0005 |
| Au-(1.5 at %)Pd | 5.70 | 0.0003 |
| Au-(3.7 at %)Pd | 6.37 | 0.0002 |
| Au-(2.1 at %)Ag | 5.28 | 0.0006 |
| Au-(5.2 at %)Ag | 5.69 | 0.0015 |
| Au-(6.4 at %)Ag | 6.20 | 0.0004 |

Surface roughness root mean square (RMS) values between 30 and 50 angstroms, typical of sputtered metal films, may be measured for each of the test specimens using a Tencor P-10 surface profiler. Once miscible alloy deposition is verified and the hardness and resistivity measurements accomplished, a contact resistance metric can be used to determine which alloy is best suited for incorporation into the micro-switch fabrication process.

2.4. Contact Resistance Performance Prediction

The contact resistance that results from making an electrical connection is defined by equation (1) that considers the effects of constriction (Rc) and contaminant film ($R_{ef}$) resistances:

$$RC=Rc+R_{cf} \tag{1}$$

Constriction resistance, due to contact surface topography or roughness, is modeled analytically using the Maxwellian spreading resistance theory:

$$Rc=\rho/2r_{eff} \tag{2}$$

where Rc is the constriction resistance, ρ is the resistivity and $r_{eff}$ is the effective radius of a circular contact area. Equation (2) assumes current flow is completely attributed to diffusive electron transport. When contact material deformation is assumed to be plastic, equation (2) is revised, using Abbott and Firestone's material deformation model, resulting in the well-known Holm's contact resistance equation:

$$Rc=\rho/2[H\pi/F_c]^{1/2} \tag{3}$$

where Fc is the contact force. Table 4 is a summary of predicted contact resistance, calculated using equation (3), measured hardness (Table 2) and measured resistivity (Table 3) values, for the candidate alloy electric contact materials. A contact resistance prediction for sputtered gold electrical contacts is also provided for comparison. The contact surfaces are assumed to be clean and free of contaminate film layers and with a normally applied contact force of 50 microNewtons in Table 4.

TABLE 4

Minimum contact resistance (Rc) predictions for candidate electric contact materials

| Metal/alloy | Predicted minimum Rc (Ω) |
|---|---|
| Au | 0.21 |
| Au-(2.2 at %)Pt | 0.30 |
| Au-(6.3 at %)Pt | 0.42 |
| Au-(10.1 at %)Pt | 0.59 |
| Au-(0.7 at %)Pd | 0.26 |
| Au-(1.5 at %)Pd | 0.31 |
| Au-(3.7 at %)Pd | 0.35 |
| Au-(2.1 at %)Ag | 0.28 |
| Au-(5.2 at %)Ag | 0.29 |
| Au-(6.4 at %)Ag | 0.32 |

Observe from Tables 2 and 4 that Au-(6.3 at %)Pt alloy has a predicted contact resistance that is comparable to Au and also has the highest measured hardness value. Based on this, MEMS test structures (i.e. micro-switches) with Au-(6.3 at %)Pt electric contacts may be configured fabricated and tested to investigate the feasibility of using alloy electric contacts and validate the procedure for selecting alloy contact metals. The configuration, fabrication and test results of cantilever-style MEMS switches with Au-(6.3 at %)Pt electric contacts are discussed next.

3.1. MEMS Switches Configuration

Figure 6:
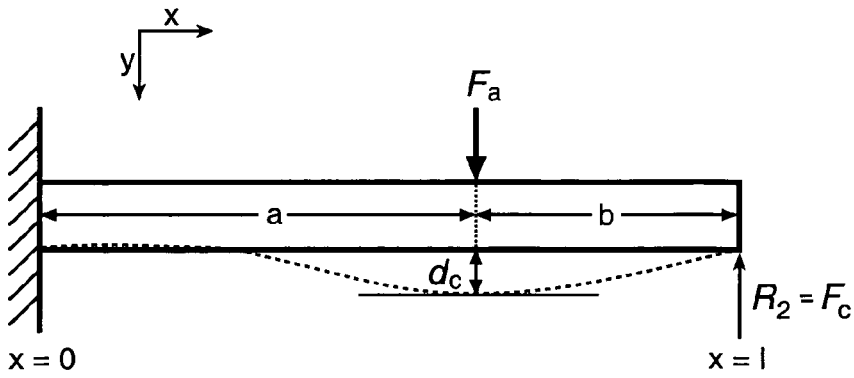
FIG. 6 shows a cantilever beam model usable to describe characteristics of a MEMS switch movable element.

In metal contact micro-switches, initial switch closure is defined by the pull-in voltage. At switch pull-in, physical contact between the upper switch contact (i.e. dimples) and lower contacts is first established with minimal contact force. As the switch actuation voltage is increased, the cantilever beam bends, contact force increases and material deformation causes the contact area to increase. Contact area friction, a result of cantilever beam bending, tends to mechanically clean (i.e. "wipe") contaminant films from the electric contact surfaces. Previous work by this patentee has demonstrated that the contact force bounded by pull-in and collapse voltages can be analytically modeled using the beam illustrated in FIG. 6. FIG. 6 shows a cantilever beam model with a fixed end at x=0, a simply supported end at x=1 and an intermediately placed external load (Fa) at x=a.

In FIG. 6 the applied load is modeled as an electrostatic force:

$$Fe=\epsilon_o A_{sa} V^2/2g^2 \quad (4)$$

where Fe is the electrostatic force, $\epsilon_o$ is the permittivity of free space, $A_{sa}$ is the surface area of one parallel plate, V is the actuation voltage and g is the gap between the parallel plates. Fe is represented by Fa in FIG. 6.

The FIG. 6 beam pull-in voltage may be determined from Equation (5)

$$Fc=[F_a/2l^3]a^2(3l-a) \quad (5)$$

where Fc is the contact force, Fa is the applied electrostatic force, a is the location of the applied electrostatic force and l is the beam length in micrometers. This simple model does not consider either beam tip deflection or contact material deformation after switch closure or pull-in. A more detailed contact force model results when electric contact material deformation, assumed to be elastic, plastic or elastic-plastic, and beam tip deflection are considered.

Figure 7:
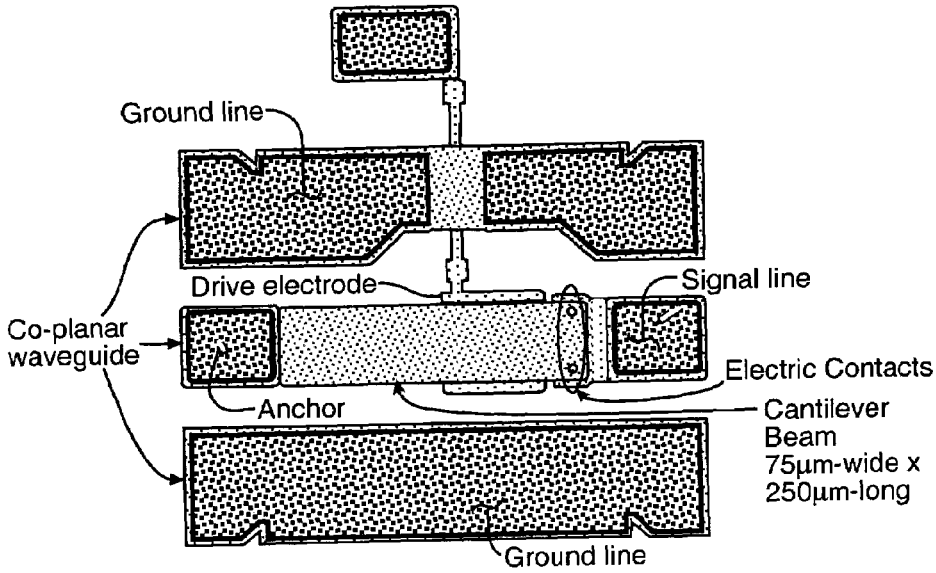
FIG. 7 shows an image of a radio frequency MEMS switch.

After selecting a candidate alloy (Au-(6.3 at %)Pt) and a compatible deposition process (i.e. co-sputtering), microswitches may be configured, using equations (4) and (5) and then fabricated using a custom process. FIG. 7 in the drawings is a captured video image of a 75 μm wide by 250 μm long RF MEMS metal contact switch with Au-(6.3 at %)Pt electric contacts achieved in this manner.

3.2. Fabrication

The cantilever-style micro-switches shown in FIG. 7, with Au-(6.3 at %)Pt electric contacts, can be fabricated on highly resistive sapphire substrates. For comparison, micro-switches with sputtered Au electric contacts may also be fabricated. Table 5 summarizes the fabrication process that may be used and the typical layer thicknesses; the above identified companion application provides additional detail.

TABLE 5

Typical layer thicknesses using a custom MEMS switch fabrication process

| Layer | Material | Thickness (μm) |
|---|---|---|
| Electrode | Evaporated gold | 0.3 |
| Lower contact | Evaporated gold/sputtered metal alloy | 0.3 |
| Beam gap | Created from sacrificial photoresist | 3.0 |
| Contact gap | Created from sacrificial photoresist | 2.0 |
| Upper contact (i.e. dimple) | Sputtered metal alloy | 0.05 |
| Beam | Electroplated gold | 5.0 |
| Co-planar waveguide | Evaporated gold/electroplated gold | 5.3 |

The drive or actuation electrode and the lower electric contact are planar while the upper contact bump or dimple is hemispherical. The electrode and lower contact can be evaporated and patterned using photolithography and then the excess material removed using a standard lift-off technique. A thin chromium (Cr) adhesion layer may be used under the evaporated Au layer. The lower contact metal, sputter deposited on top of the evaporated layer, can be patterned using photolithography and then excess material removed using a lift-off technique. The beam gap may be created from a sacrificial photoresist layer.

Figure 8:
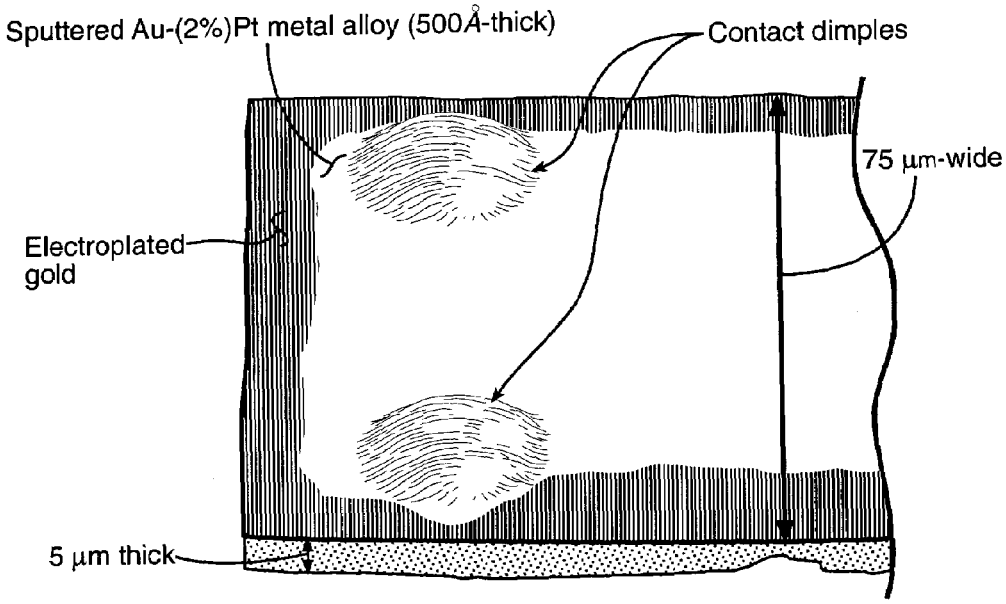
FIG. 8 shows an image of a radio frequency MEMS switch cantilever underside.

The beam hinge geometry and upper contact dimples may be defined in the sacrificial photoresist using standard photolithography. A timed re-flow in an oven may be used to reform, by surface tension, the usual 'plug-shaped' dimple into a hemisphere-shaped contact bump similar to those shown in FIG. 8. FIG. 8 shows the appearance of a scanning electron micrograph (SEM) image of a 'flipped' over MEMS switch cantilever showing the alloy contact material on the hemispherical-shaped upper contact bumps located on the underneath face of the beam. The cantilever in FIG. 8 is 75 micrometers wide, as appears in the vertical direction, and approximately 5 micrometers thick. The cantilever is covered with sputtered Au-(2 at %) platinum metal alloy of 500 Angstroms thickness in the central region where the two 8 micrometer contact dimples are located and this is surrounded by a region of electroplated gold The upper contact metals may be sputter deposited and patterned using photolithography. The excess metal, can be removed using an etch-back technique, instead of liftoff, to avoid damaging the sacrificial photoresist layer. After electroplating the cantilever's gold structural layer, the devices can be released using a $CO_2$ critical point dryer and tested to ensure proper device operation and performance.

Testing

Figure 9:
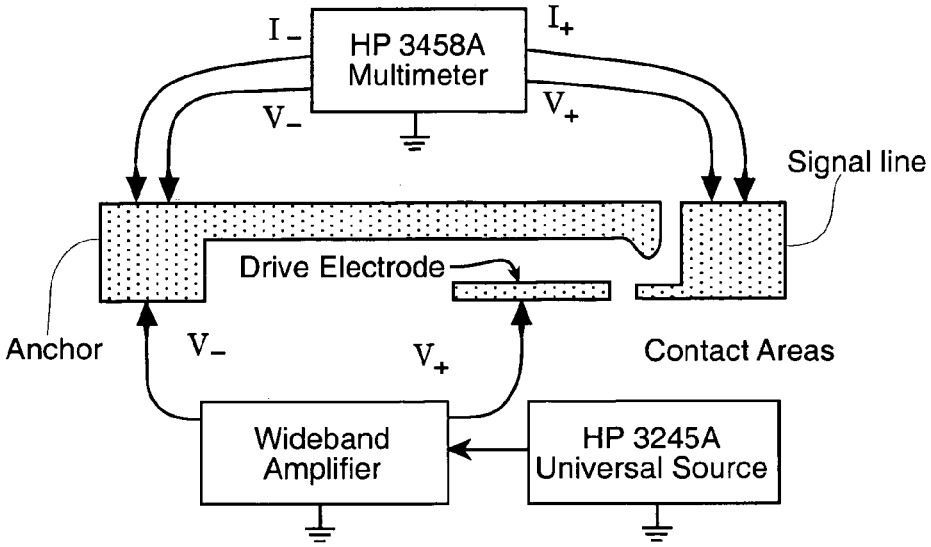
FIG. 9 shows a test arrangement useful to measure electrical resistance and life cycle durability of a radio frequency MEMS switch.

A series of micro-switches, like that shown in FIG. 7, may be tested to experimentally characterize the contact resistance and lifetime for switches with Au and Au-(6.3 at %)Pt electric contacts. Such switches may be tested by wafer probing in the manner shown in FIG. 9 using an Alessi Rel-4100A Microprobe Station with standard microprobes. The actuation voltage may be applied during a FIG. 9 test using an HP 3245A universal source and a Krohn-Hite wideband amplifier, and may be swept from 0 to 110 V in 0.5 V increments. Closed switch resistance may be measured using an HP 3458A multimeter in a four-point probe configuration as shown in FIG. 9. Contact resistance may be determined by subtracting the measured resistance of the cantilever beam from the measured closed switch resistance values. FIG. 9 is a schematic illustration of the experimental setup.

During contact resistance testing a plurality of individual switches, such as ten, may be tested by way of applying a bias or actuation voltage between the cantilever beam and the drive electrode. A switch closes when the magnitude of the bias voltage exceeds the pull-in voltage. As the applied bias increases beyond the pull-in voltage, the contact force increases until beam collapse onto the drive electrode occurs. The maximum contact force and minimum contact resistance occur just prior to reaching the beam collapse voltage. Once collapse is reached, the switch becomes shorted and is no longer operable. Table 6 summarizes the minimum average contact resistance (Rc) for MEMS switches with sputtered Au and Au-(6.3 at %)Pt electric contacts.

TABLE 6

Average minimum contact resistance measurements for MEMS switches with Au and Au-(6.3 at %)Pt electric contacts.

| Metal/alloy | Min avg Rc (Ω) | Std dev (Ω) | Pull-in, $V_p$i | Switch life, cycles |
|---|---|---|---|---|
| Au | 1.17 | 0.14 | 36.2 | $1.05 * 10^8$ |
| Au-(6.3 at %)Pt | 1.87 | 0.37 | 44.3 | $1.87 * 10^8$ |

Figure 10:
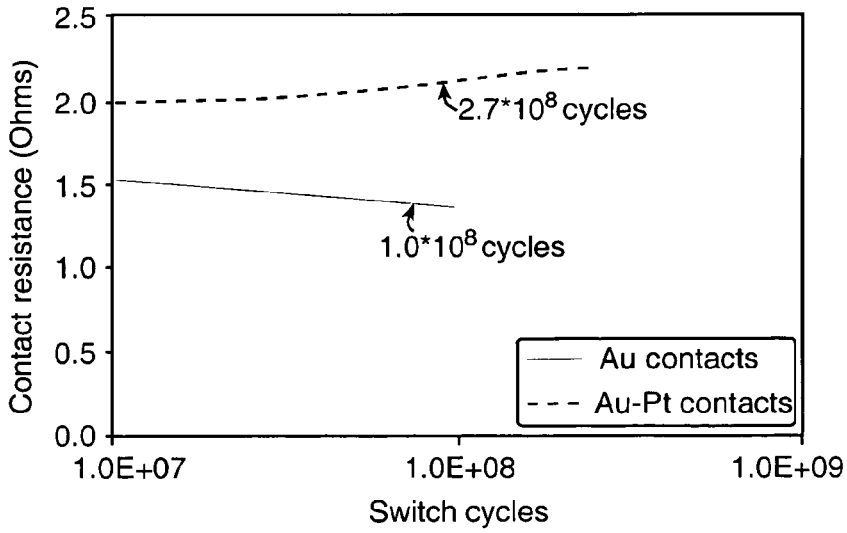
FIG. 10 shows a relationship between radio frequency MEMS switch contact resistance and switch operating cycles.

During life cycle testing switches may be operated continuously just below the resonant frequency (50 kHz) with an actuation voltage set to the pull-in voltage plus about 1-3 V for increased contact force. The devices may be cycled until they either fail open (i.e. infinite resistance) or closed (i.e. stuck down). During each switch actuation, the devices may be 'hot switched' with the multimeter's open circuit voltage of about 8.2V. The Hewlett Packard multimeter is limited to a current flow of one milliamp while making such measurements. A switch success criteria may be chosen as contact resistance values less than approximately 3 ohms. Contact resistance versus switch cycle raw data, for selected micro-switches, can be curve fitted and the resulting trend lines plotted in the manner shown in FIG. 10. Generally, micro-switches with Au electric contacts are limited to approximately $10^6$ 'hot-switched' cycles because evaporated Au is a soft metal and prone to wear [1]. Majumder et al report greater than $10^7$ 'hot-switched' cycles and approximately $10^{11}$ 'cold-switched' cycles for devices with a 'platinum group' electric contact metal [1]. The micro switches with Au-(6.3 at %)Pt contacts when 'hot-switched and result in contact resistance between 1.5 and 2.2 ohms and, when compared to micro-switches with sputtered Au electric contacts, exhibit approximately a 2.7 times increase in switching lifetime. This is most likely due to the increased material hardness of the sputtered alloy contact films. Also, the micro-switches with sputtered Au contacts outperform other micro-switches with evaporated Au contacts [2]. Once again, this is most likely due to the increased material hardness of the sputtered Au contact metals. The measured Meyer hardness of evaporated Au, sputtered Au and co-sputtered Au-(6.3 at %)Pt thin films (500 Angstroms thick) are approximately 1, 2 and 2.2 GPa, respectively. Micro-switches with Au-(6.3 at %)Pt contacts exhibit an increase in contact resistance with increased numbers of switch cycles. FIG. 10 shows a rise in contact resistance between approximately $3\times10^7$ and $2.7\times10^8$ switch cycles. This is believed to indicate that a contaminant film layer, induced by contact wear, is developing.

The alloys and compositions presented here are chosen to avoid two-phase alloy regions, intermetallic compound formation, the need for high switch actuation voltages and to allow for the testing of unpackaged switch devices. Such considerations help ensure that switch device fabrication is consistent and repeatable.

While the apparatus and method herein described constitute a preferred embodiment of the invention, it is to be understood that the invention is not limited to this precise form of apparatus or method and that changes may be made therein without departing from the scope of the invention, which is defined in the appended claims.

We claim:

1. The method of achieving a gold alloy contact-inclusive radio frequency microelectromechanical systems switch comprising the steps of:

electing a microelectromechanical systems switch mechanism configuration providing a selected range of switch electrical contact force capability and limited switch electrostatic pull-in voltage requirement;

selecting candidate radio frequency microelectromechanical systems electrical switch contact metal alloys for use with said elected switch mechanism configuration from a collection of gold inclusive binary miscible alloys;

said selecting step including embracing a plurality of gold inclusive alloys of suitable equilibrium binary alloy phase diagrams and known suitable binary alloy bulk material resistivity data for said candidate gold inclusive alloys;

said selecting step additionally including exclusion of candidate gold alloys having multiple stable alloy phases and intermetallic compound attributed phase diagram regions;

said selecting step further including exclusion of gold alloy combinations having electrical resistivity characteristics in excess of a selected level;

said selecting step alloy having one of, a palladium of concentration of less than ten percent, a platinum of concentration of less than fifteen percent and a silver concentration of less than fifteen percent;

choosing an appropriate thin film deposition method for a contact alloy designated from said selected candidate radio frequency microelectromechanical systems switch contact gold inclusive alloys; and forming said designated alloy using one of a physical vapor deposition process and a chemical vapor deposition process operating at an alloying temperature below that of phase diagram multiple phases formation and phase diagram miscibility gap occurrence.

2. The method of achieving a gold alloy contact-inclusive radio frequency microelectromechanical systems switch of claim 1 further including the steps of: measuring specific thin film electrical properties from samples of said designated gold inclusive alloy for magnitudes falling within a specific range thereof; and predicting closed microelectromechanical electrical systems radio frequency electrical switch contact electrical resistance properties from said measured properties and a selected contact resistance model; excluding gold alloys affording contact resistance above a selected value from said designated alloys.

3. The method of achieving a gold alloy contact-inclusive radio frequency microelectromechanical systems switch of claim 1 wherein said elected micromechanical electrical systems radio frequency electrical switch configuration includes a cantilever beam structure having a simply supported beam end-point at one extremity thereof.

4. The method of achieving a gold alloy contact-inclusive radio frequency microelectromechanical systems switch of claim 1 wherein said designated alloy is further selected for having desirable ranges of tradeoff between alloy bulk resistivity and one of alloy hardness and alloy elastic modulus characteristics.

5. The method of achieving a gold alloy contact-inclusive radio frequency microelectromechanical systems switch of claim 1 wherein said designated alloy is further selected for having selected tolerance to tarnish conditions and selected surface film formation immunity.

6. The method of achieving a gold alloy contact-inclusive radio frequency microelectromechanical systems switch of claim 5 wherein said designated alloy selected tolerance to tarnish conditions and selected surface film formation immunity includes substantial immunity to insulating oxide and sulfide film formation.

7. The method of achieving a gold alloy contact-inclusive radio frequency microelectromechanical systems switch of claim 1 wherein said designated alloy is also selected for having desirable thermal conductivity, desirable hardness and desirable elastic modulus characteristics.

8. The method of achieving a gold alloy contact-inclusive radio frequency microelectromechanical systems switch of claim 7 wherein said designated alloy includes a second non gold component metal of insufficient concentration in said alloy to support phase diagram multiple phase regions at alloy formation temperatures.

9. The method of achieving a gold alloy contact-inclusive radio frequency microelectromechanical systems switch of claim 1 wherein said designated alloy is one of a gold and palladium alloy, a gold and silver alloy and a gold and platinum alloy.

10. The method of achieving a gold alloy contact-inclusive radio frequency microelectromechanical systems switch of claim 9 wherein said designated alloy includes palladium of concentration less than ten percent.

11. The method of achieving a gold alloy contact-inclusive radio frequency microelectromechanical systems switch of claim 9 wherein said designated alloy includes platinum of concentration less than fifteen percent.

12. The method of achieving a gold alloy contact-inclusive radio frequency microelectromechanical systems switch of claim 9 wherein said designated alloy includes silver of concentration less than fifteen percent.

13. The method of achieving a gold alloy contact-inclusive radio frequency microelectromechanical systems switch of claim 9 wherein said designated alloy includes a second non gold component metal of insufficient concentration in said alloy to support phase diagram miscibility gaps.

14. The method of achieving a gold alloy contact-inclusive radio frequency microelectromechanical systems switch of claim 9 wherein said method includes formation of said designated alloy at an alloying temperature below that of phase diagram multiple phases formation and phase diagram miscibility gap occurrence.

15. The method of achieving a gold alloy contact-inclusive radio frequency microelectromechanical systems switch of claim 1 wherein said thin film deposition method comprises one of a physical vapor deposition process and a chemical vapor deposition process.

16. The method of achieving a gold alloy contact-inclusive radio frequency microelectromechanical systems switch comprising the steps of:

electing a microelectromechanical electrical systems electrical switch mechanism configuration providing a selected range of switch electrical contact force capability and limited switch electrostatic pull-in voltage requirement;

selecting candidate radio frequency microelectromechanical systems electrical switch contact metal alloys for use with said elected switch mechanism configuration from a collection of gold inclusive binary miscible alloys;

said selecting step including embracing a plurality of gold inclusive alloys of suitable equilibrium binary alloy phase diagrams and known suitable binary allow bulk material resistivity data for said candidate gold inclusive alloys;

said selecting step additionally including exclusion of candidate gold alloys having multiple stable alloy phases and intermetallic compound attributed phase diagram regions; said selecting step further including exclusion of gold alloy combinations having electrical resistivity characteristics in excess of a selected level; said selecting step alloy having one of a palladium of concentration of less than ten percent, a platinum of concentration of less than fifteen percent and a silver concentration of less than fifteen percent;

choosing an appropriate thin film deposition method for a trial contact alloy designated from said selected candidate radio frequency microelectromechanical systems electrical switch contact gold inclusive alloys; and forming said designated alloy using one of a physical vapor deposition process and a chemical vapor deposition process operating at an alloying temperature below that of phase diagram multiple phases formation and phase diagram miscibility gap occurrence.

* * * * *